US005558036A

United States Patent [19]

Hara

[11] Patent Number: 5,558,036

[45] Date of Patent: Sep. 24, 1996

[54] INTEGRATED TUG/BARGE SYSTEM WITH RIDING PUSHER BOAT

[75] Inventor: James H. Hara, Ridgefield, Conn.

[73] Assignee: Skarhar, Inc., Greenwich, Calif.

[21] Appl. No.: 373,578

[22] Filed: Jan. 17, 1995

[51] Int. Cl.[6] ..... B63B 21/58

[52] U.S. Cl. ..... 114/249

[58] Field of Search ..... 114/242, 244, 114/246, 248, 249, 250, 251, 77 R

[56] References Cited

U.S. PATENT DOCUMENTS

| | | | |
|---|---|---|---|
| 3,557,741 | 1/1971 | Teasdale | 114/248 |
| 3,633,532 | 1/1972 | Bruce | 114/248 |
| 3,815,539 | 6/1974 | Stevens | 114/248 |
| 3,842,782 | 10/1974 | Cuttica | 114/248 |
| 5,165,357 | 11/1992 | Kawasaki | 114/248 |

*Primary Examiner*—Stephen Avila
*Attorney, Agent, or Firm*—John H. Crozier

[57] ABSTRACT

An integrated tug/barge (ITB) for carrying cargo, including: a cargo carrying barge having no means of propulsion; and a tug boat mounted on top of the barge such that the tug boat and the barge will experience identical motion when the ITB is operated, the tug boat including apparatus for propulsion and maneuvering of the ITB. In a further aspect, a method of launching a tug boat from the ITB, the method including: pushing the tug boat aftward until the center of gravity thereof is aft of a knuckle point formed by horizontal and sloped portions of the floor of a recess in which the tug boat is mounted; and permitting the tug boat to slide down the sloped portion of the bottom of the recess into water in which the barge is floating. In an additional aspect, a method of forming the ITB, the method including: ballasting the barge so that the bottom of the recess is under the surface of the water; using the apparatus for propulsion to propel the tug boat into the recess; securing the tug boat to the barge; and reballasting the barge to a normal position in the water.

24 Claims, 7 Drawing Sheets

INTEGRATED TUG/BARGE SYSTEM WITH RIDING PUSHER BOAT

BACKGROUND OF THE INVENTION

1. Field of the Invention

The present invention relates to marine cargo barges generally and, more particularly, but not by way of limitation, to a novel integrated tug/barge system having a riding pusher boat to propel the integrated tug/barge.

2. Background Art

There are two "Integrated Tug/Barge" (ITB) modes provided by United States Coast Guard (USCG) Regulations: (1) towing a barge with a tug boat, and (2) a dual purpose mode which consists of towing and pushing. Pushing is relatively superior to towing in maneuvering a barge because of the greater degree of control a tug boat has over a barge when pushing it. There are two operation methods when pushing a barge: (1) a tug boat is used to push the barge's stern, such as in Mississippi River barge operations, with the tug and barge tied together by lines, and (2) a tug boat located in a notch in the stern of the barge propels the barge, with the tug boat and barge being joined by lines or by pivoting arms. A variation of the first pushing method is to have the tug boat lashed alongside the barge. These methods work well in calm seas.

In rough seas, a large differential in motion between the tug boat and the barge, especially pitching motion, can occur, due to different wave heights and directions for the tug and the barge because the tug boat and barge have different buoyancies which results in unequal wave height. While the barge might pass through certain waves with little or no pitching motion, the tug boat might experience a very heavy pitching motion and one at a different frequency than that experienced by the barge, due to the foregoing reasons. Therefore, collision damage to the barge notch can occur, due to the rough motion of the bow of the tug boat. Also, joint arm damage can occur, due to severe torque resulting from unbalanced wave motion.

There have been documented several major damage incidents in barge transportation the main causes of which were the poor and unstable conditions in ITBs. Many articles have been written stating that further improvement of ITB systems is required for the safe working of barges in United States waters.

Accordingly, it is a principal object of the present invention to provide a system to join a tug boat and a barge in such a manner as to avoid the differential motion problems described above.

It is a further object of the invention to provide such a system that provides for rapid unjoining of the tug boat in the event of an emergency.

It is an additional object of the invention to provide such a system which can be easily employed.

It is another object of the invention to provide such a system in which the tug boat can mount the barge under its own power.

Other objects of the present invention, as well as particular features, elements, and advantages thereof, will be elucidated in, or be apparent from, the following description and the accompanying drawing figures.

SUMMARY OF THE INVENTION

The present invention achieves the above objects, among others, by providing, in one preferred embodiment, an integrated tug/barge for carrying cargo, comprising: a cargo carrying barge, said barge having no means of propulsion; and a tug boat mounted on top of a portion of said barge such that said tug boat and said barge will experience identical motion when said integrated tug/barge is operated, said tug boat including means for propulsion and maneuvering of said integrated tug/barge. In a further aspect of the invention, there is provided a method of launching a tug boat from an integrated tug/barge, said tug/barge including: a cargo carrying barge, said barge having no means of propulsion; a tug boat mounted in a recess formed in a portion of said barge such that said tug boat and said barge will experience identical motion when said integrated tug/barge is operated, said tug boat including means for propulsion and maneuvering of said integrated tug/barge; a first, forward portion of the hull bottom of said tug boat is flat and horizontal, a second portion of said hull bottom is flat and inclined aftwardly and downwardly from said first portion, and a sloped portion of said bottom of said recess and a horizontal portion of said bottom of said recess are joined at a knuckle point and engage, respectively, said first and second portions of said hull bottom of said tug boat; and said tug boat having its center of gravity forward of said knuckle point when said tug boat is mounted on said barge; said method comprising: pushing said tug boat aftward until said center of gravity is aft of said knuckle point; and permitting said tug boat to slide down said sloped portion of said bottom of said recess into water in which said barge is floating. In an additional aspect of the invention, there is provided a method of forming an integrated tug/barge, said tug/barge including: a cargo carrying barge, said barge having no means of propulsion; a tug boat mounted in a recess formed in a portion of said barge such that said tug boat and said barge will experience identical motion when said integrated tug/barge is operated, said tug boat including means for propulsion and maneuvering of said integrated tug/barge; said method comprising: ballasting said barge so that the bottom of said recess is under the surface of water in which said tug boat and said barge are floating; using said means for propulsion to propel said tug boat into said recess; securing said tug boat to said barge; and reballasting said barge to a normal position in said water.

BRIEF DESCRIPTION OF THE DRAWING

Understanding of the present invention and the various aspects thereof will be facilitated by reference to the accompanying drawing figures, submitted for purposes of illustration only and not intended to define the scope of the invention, on which.

DETAILED DESCRIPTION OF THE PREFERRED EMBODIMENTS

Figure 1:
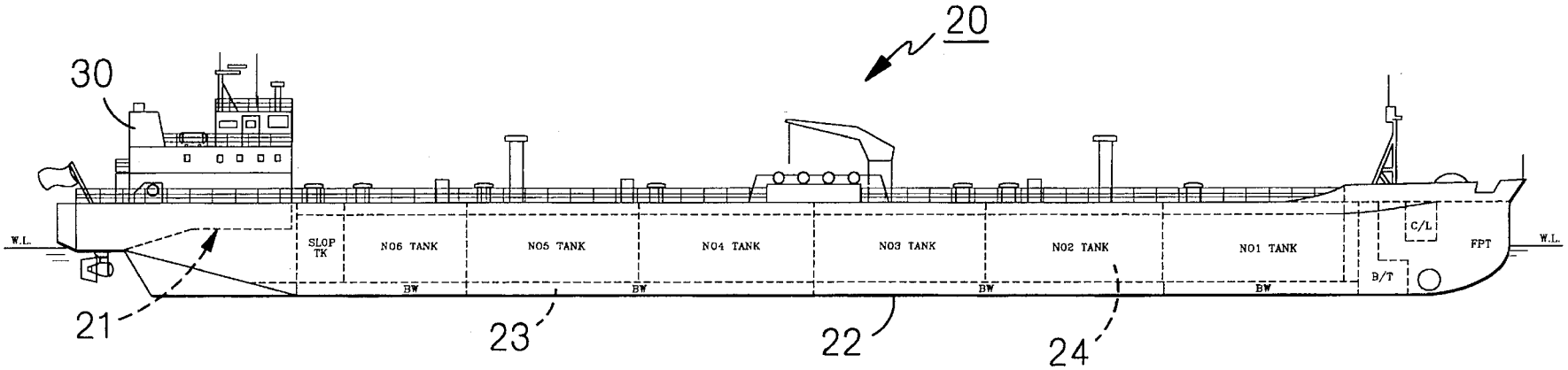
FIG. 1 is a side elevational view of an Integrated Tug/Barge (ITB) incorporating the present invention.

Reference should now be made to the drawing figures, on which similar or identical elements are given consistent identifying numerals throughout the various figures thereof, and on which parenthetical references to figure numbers direct the reader to the view(s) on which the element(s) being described is (are) best seen, although the element(s) may be seen also on other views.

FIG. 1 illustrates an Integrated Tug/Barge (ITB) constructed according to the present invention and generally indicated by the reference numeral 20. ITB 20 includes a barge 22 having therein a plurality of holds, or tanks, as at 24, to carry therein cargo. Barge 22 also includes a plurality of ballast tanks, as at 23, disposed in the lower portion of the hull thereof. By definition, a barge is a marine vehicle to carry cargo, without any propulsive function, but the barge may have a generator for cargo handling and mooring functions.

Mounted in a "drydock type" recess 21 formed in the stern section of barge 22 is a tug boat, or riding pusher boat, 30. Recess 21 and surrounding structure (details not shown) are designed to be strong enough to support the total weight of riding pusher boat 30, with additional allowance for the various forces developed due to dynamic motion during operation of ITB 20.

Figure 3C:
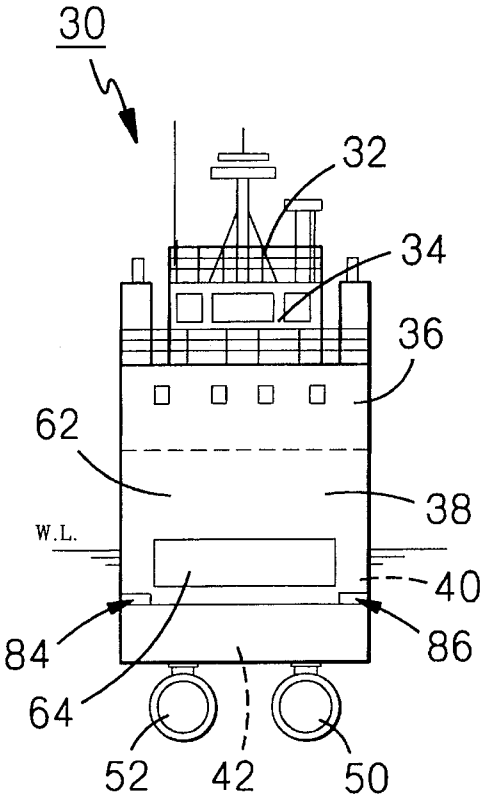
FIGS. 3(A), 3(B), and 3(C) are rear elevational, side elevational, and front elevational views, respectively of the tug boat, or riding pusher boat, of the present invention.
Figure 3B:
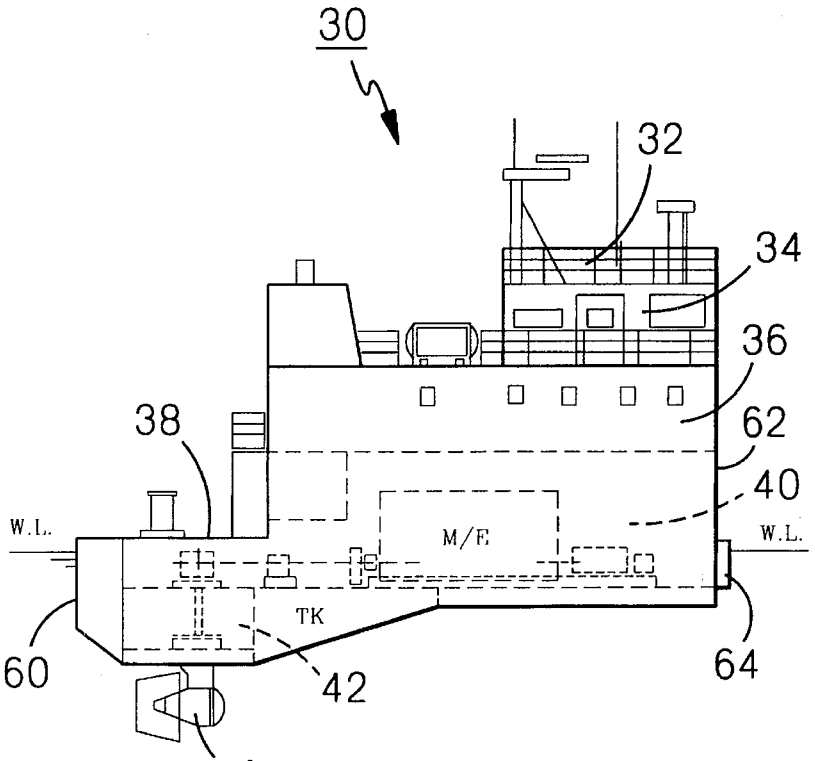
Figure 3A:
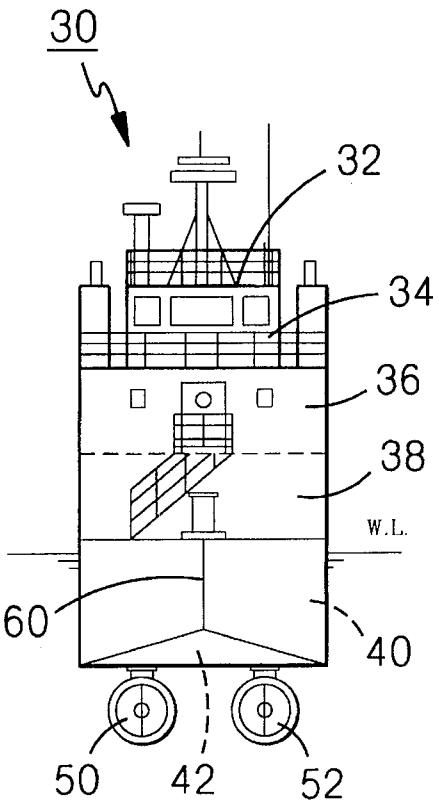

As is more clearly seen on FIGS. 3(A)–3(C) and as often provided in conventional tug boats, riding pusher boat 30 includes a compass bridge 32, a wheelhouse 34, a stateroom deck 36, a main deck 38, an engine room 40, and a lower mechanical level 42, containing the conventional elements for the operation, propulsion, and control of the riding pusher boat and housing auxiliary equipment and accommodations for the crew. It will be understood, of course, that, depending on the size of riding pusher boat 30, some of the above may be combined. Two, Z-drive, azimuthing thrusters 50 and 52 are mounted in the stern section of riding pusher boat 30 and are powered by main engines in engine room 40. Riding pusher boat 30 has a pointed stern 60 and a blunt bow 62, with a molded resilient fender 64 fixedly attached to the bow. The purpose of channels 84 and 86 shown on FIG. 3(C) will be described below with reference to FIGS. 6(A) and 6(B).

Riding pusher boat 30 is secured in recess 21 (FIGS. 1 and 2) by means of suitable quickly released means (not shown), such as a railroad car coupling mechanism, or securing mechanism(s) used in dry dock operations, between the riding pusher boat and barge 22, with fender 64 engaging the forward wall of recess to cushion the riding pusher boat against the barge. Suitable resilient buffering cushion pads (not shown) are disposed on the sidewalls and bottom of recess 21 in contact with the hull of riding pusher boat 30.

So disposed, riding pusher boat 30 is securely fixed to barge 22 in a stable condition and, therefore, is able to provide propulsion and steering for the barge without the problems discussed above with respect to differential wave action and other differential motions, since the riding pusher boat and the barge will have exactly the same hull motions.

Figure 2:
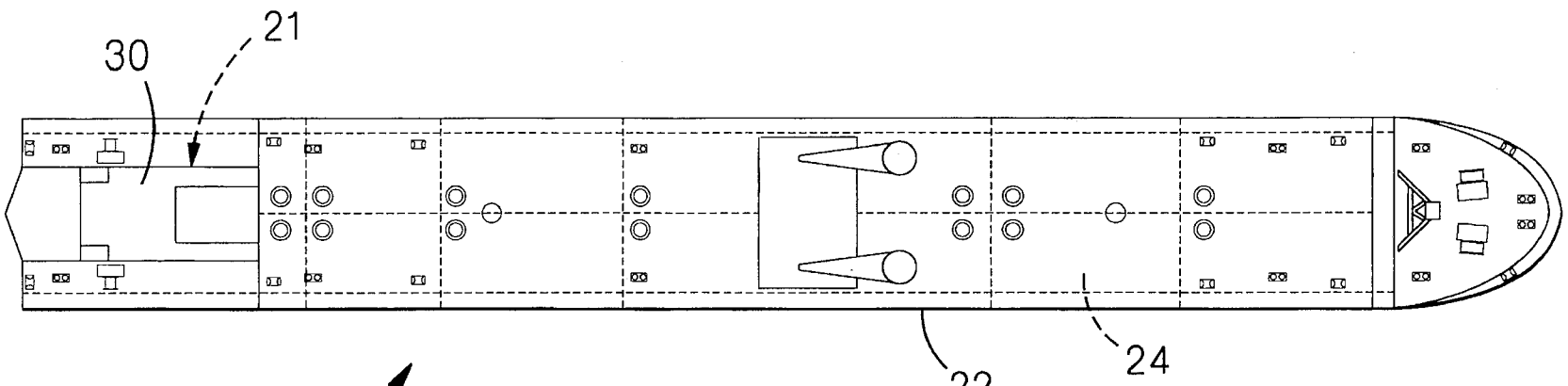
FIG. 2 is a top plan view of the ITB.
Figure 4A:
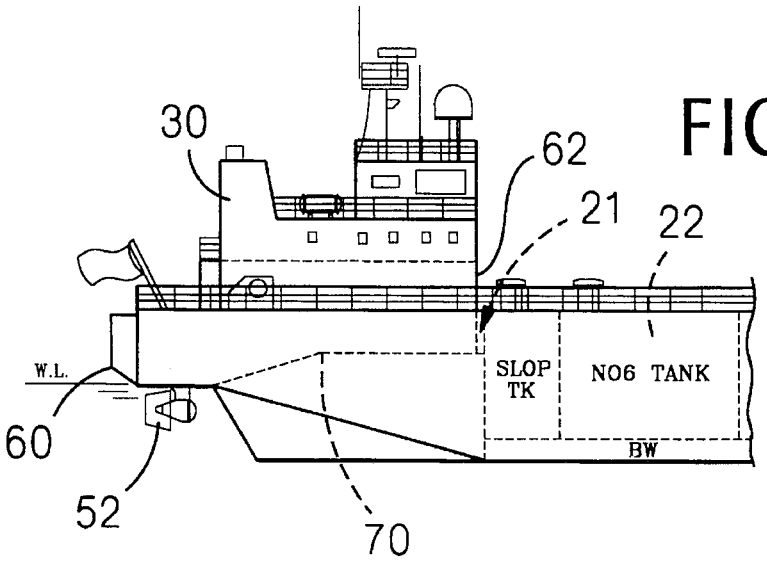
FIGS. 4(A)–(F) are fragmentary, side elevational views, of the pusher boat being separated from the barge.
Figure 4B:
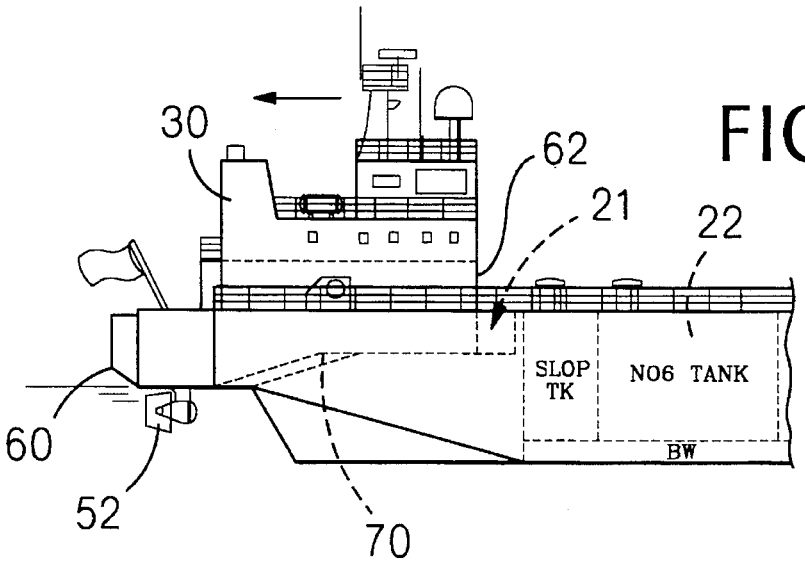
Figure 4C:
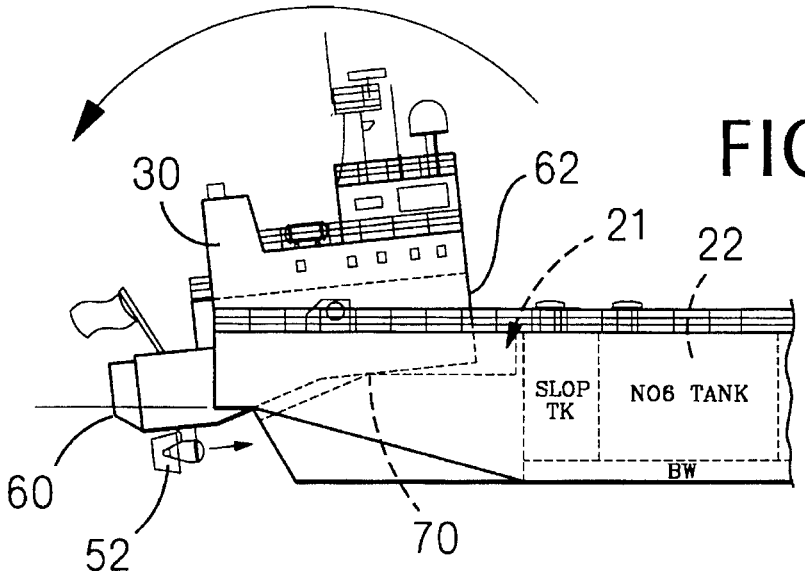
Figure 4D:
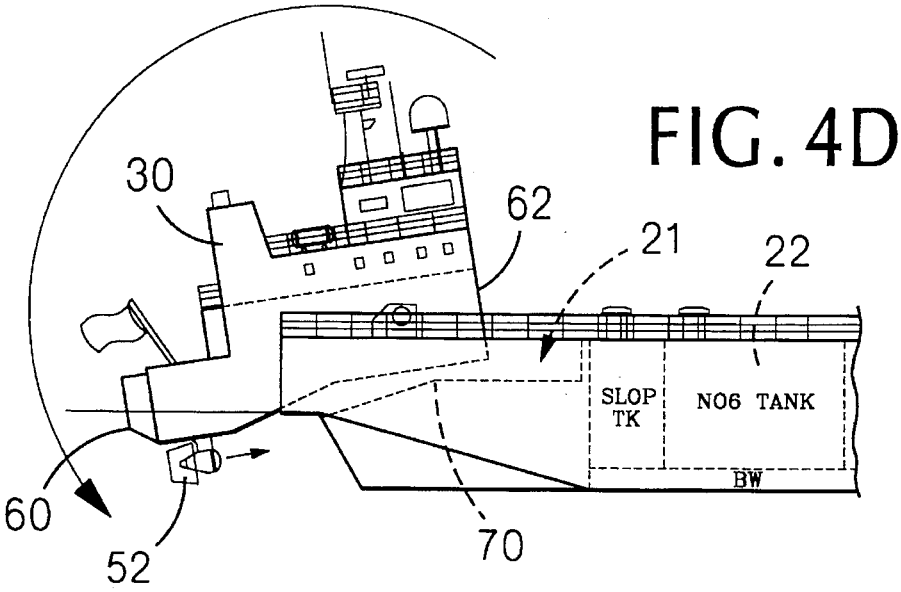
Figure 4E:
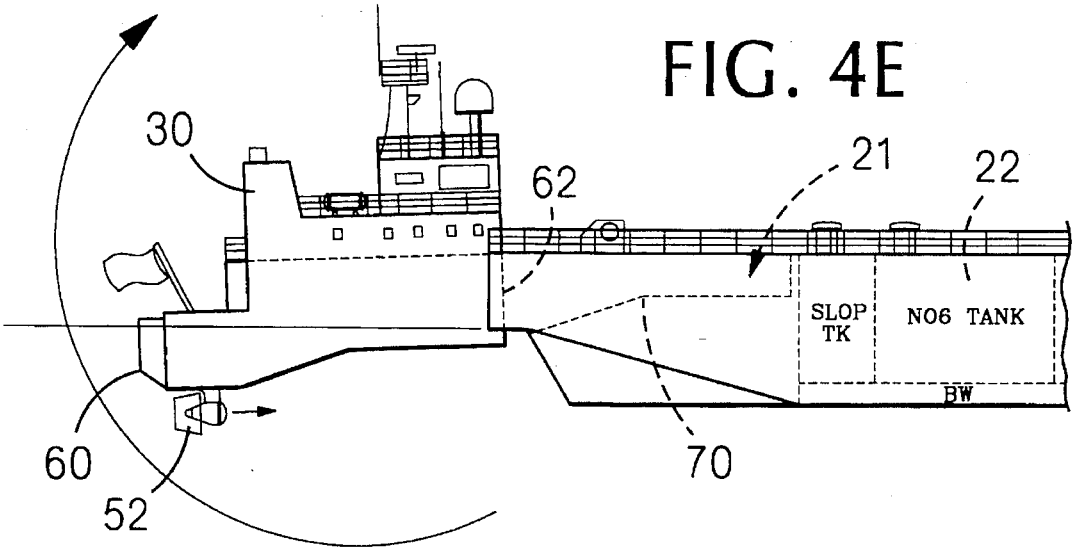
Figure 4F:
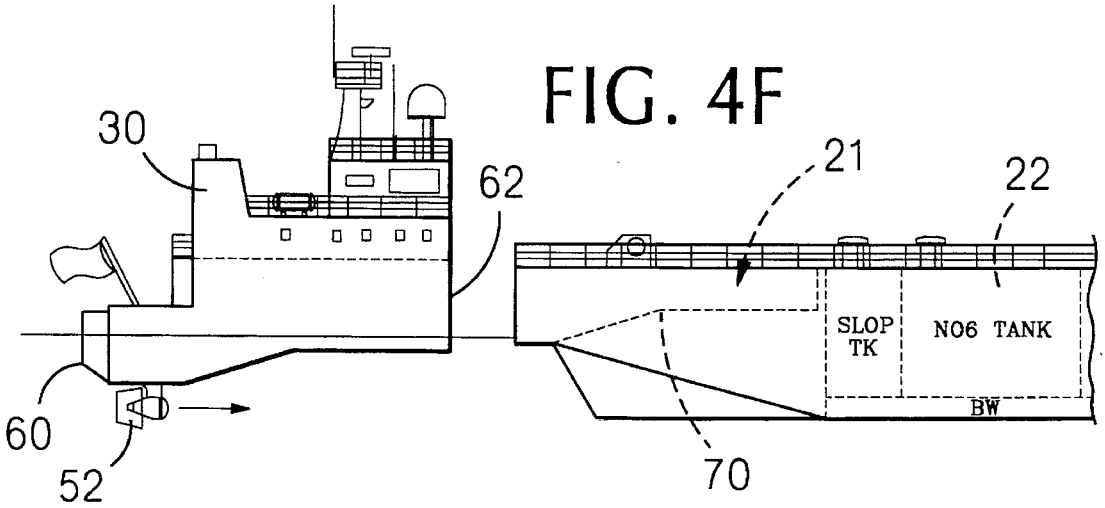

Riding pusher boat 30 will remain in the position shown on FIGS. 1, 2, and 4(A) throughout normal operation of ITB 20 to provide propulsion and steering functions. However, riding pusher boat 30 also provides another function: that of serving as a quickly deployed, self-contained lifeboat in case ITB 20 should be in danger of sinking. This function is shown on FIGS. 4(A)–4(F). FIG. 4(A) shows riding pusher boat 30 disposed in normal position mounted in recess 21 of barge 22. Should an emergency arise in which it is necessary to launch riding pusher boat 30 from barge 22, the mechanism(s) attaching the riding pusher boat to the barge are released, thrusters 50 and 52 are placed in reverse, and the riding pusher boat moves aft relative to the barge, as shown on FIG. 4(B). When the center of gravity of riding pusher boat 30 has moved aft of a knuckle point 70 defined between flat and inclined portions of the bottom of recess 21 which conformly mate with the corresponding surfaces of the riding pusher boat, the riding pusher boat rotates counterclockwise, as shown on FIG. 4(C) and (D). As the lower edge of bow 62 of riding pusher boat 30 slides off the inclined portion of the bottom of recess 21 and clears the same, the riding pusher boat 30 rotates clockwise to a normal position in the water (FIG. 4(E)) and the riding pusher boat is propelled hard astern to clear barge 22. Pointed stern 60 of riding pusher boat 30 permits the smooth entry of the riding pusher boat into the water. Since almost all functions of ITB 20 take place in riding pusher boat 30 while the ITB is underway, all crew members would normally be in the riding pusher boat most of the time and, thus, all or most would be saved.

Figure 5:
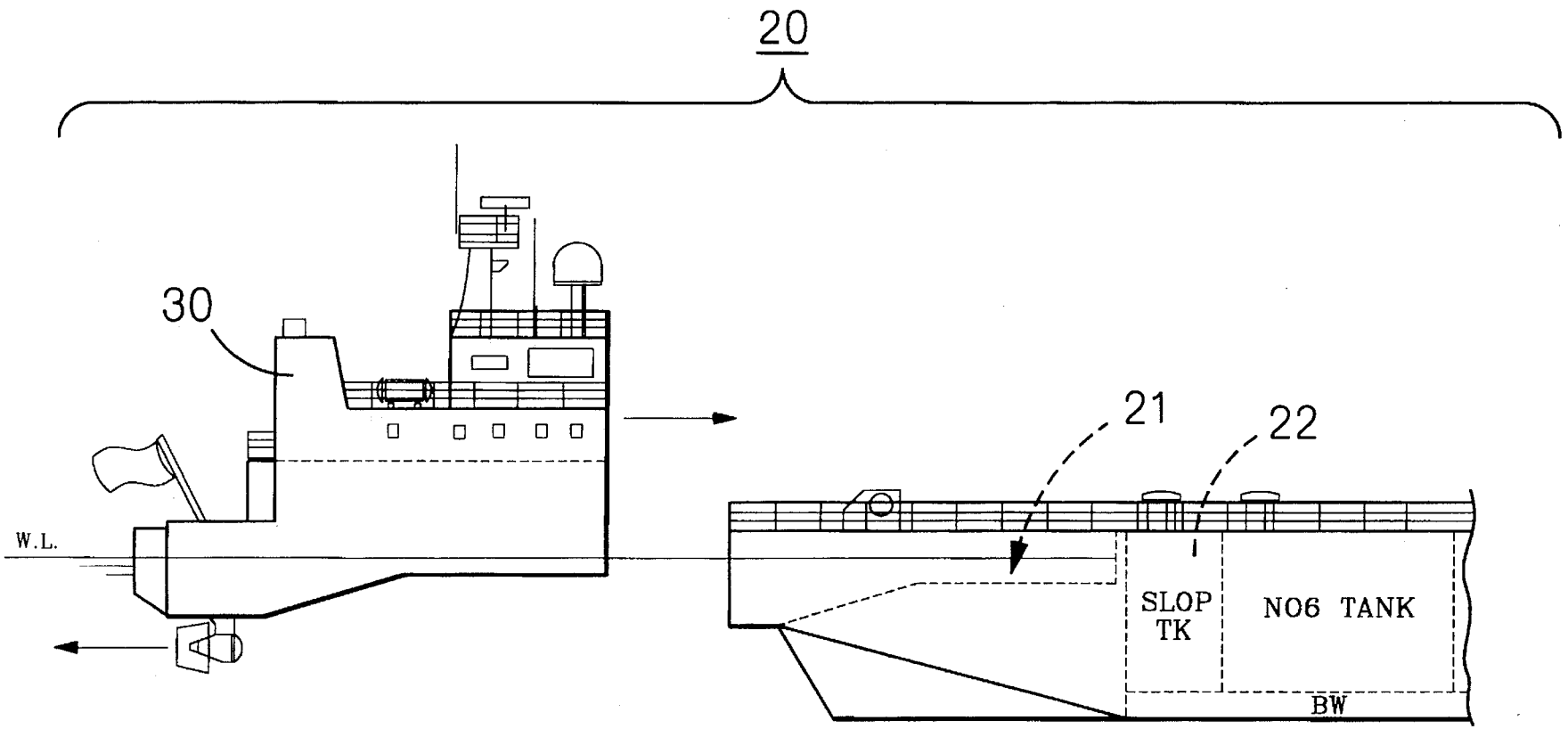
FIG. 5 is a fragmentary, side elevational view illustrating one method by which the pusher boat may be mounted on the barge, using the propulsion means of the pusher boat.

While riding pusher boat may be set in recess 21 by a crane or similar means (neither shown) to form ITB 20, riding pusher boat 30 may also enter recess 21 under its own power. This is illustrated on FIG. 5 where barge 20 has been ballasted so that the stern portion thereof is lowered in the water to partially fill recess 21. With the stern portion of barge 22 so lowered, riding pushing boat 30 can enter recess 21 under its own power, as illustrated. Once riding pusher boat 30 is positioned in recess 21, the attachment means (not shown) are secured and barge 22 is reballasted so that ITB 20 assumes its normal orientation in the water.

Figure 6A:
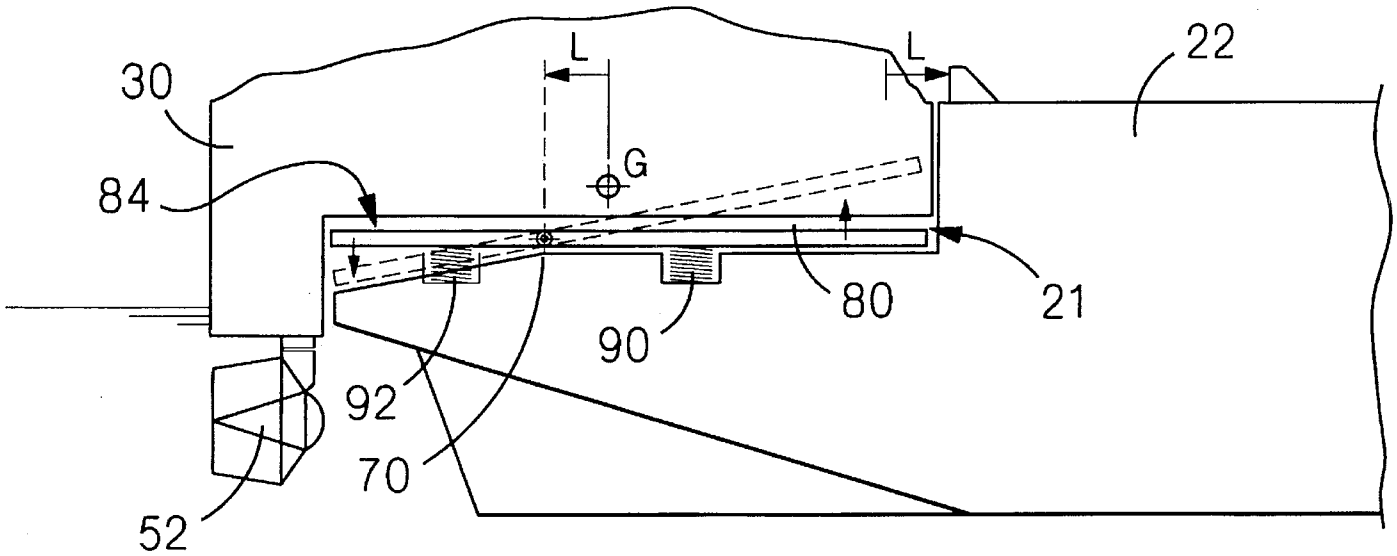
FIGS. 6(A) and 6(B) are fragmentary, partially schematic, side elevational and front elevational views, respectively, of a device mounted on the barge to assist in separating the pusher boat from the barge.
Figure 6B:
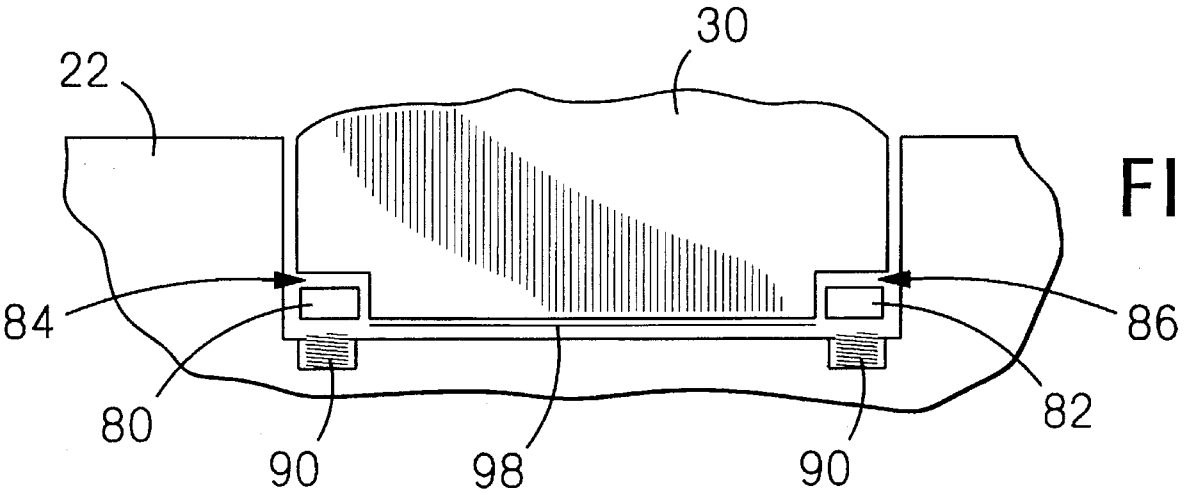

FIGS. 6(A) and 6(B) illustrate a device for assisting in launching riding pusher boat 30 from recess 21, the device including a pair of parallel rails 80 and 82 which engage, respectively, the upper surfaces of channels 84 and 86 (FIG. 6(B), also FIG. 3(C)) formed along the lower edges of the hull of the riding pusher boat, the rails being pivotable about points near knuckle point 70. It can be seen that the center of gravity "G" of riding pusher boat 30 is disposed forward of knuckle point 70 a distance "L" to help maintain stability of the riding pusher boat when fully disposed in its normal position in recess 21. With reference to FIG. 6(A), a first pair of hydraulic devices 90 (only one shown on FIG. 6(A)) disposed in the floor of recess 21, forward of knuckle point 70, is compressed when riding pusher boat 30 is in normal position in recess 21 (rail 80 in solid lines). At the same time, a second pair of hydraulic devices 92 (only one shown on FIG. 6(A)) also disposed in the floor of recess 21, aft of knuckle point 70, is extended to rails 80 and 82 to additionally maintain stability. When an emergency arises, requiring the launching of riding pusher boat 30, the riding pusher boat is moved aft a distance "L" by the action of detaching the connecting means and reversing thrusters 50 and 52, and with the possible assistance of a hydraulically operated cylinder or other such biasing means (neither shown), and further aft movement of the riding pusher boat causes unbalanced momentum in the launching operation. At the same time, hydraulic devices 90 are extended and hydraulic devices 92 are compressed, the total action causing rails 80 and 82 to rotate the position shown in broken lines, with the riding pusher boat rotating counterclockwise and beginning to slide into the water (FIGS. 4(B)–4(D)).

Figure 7A:
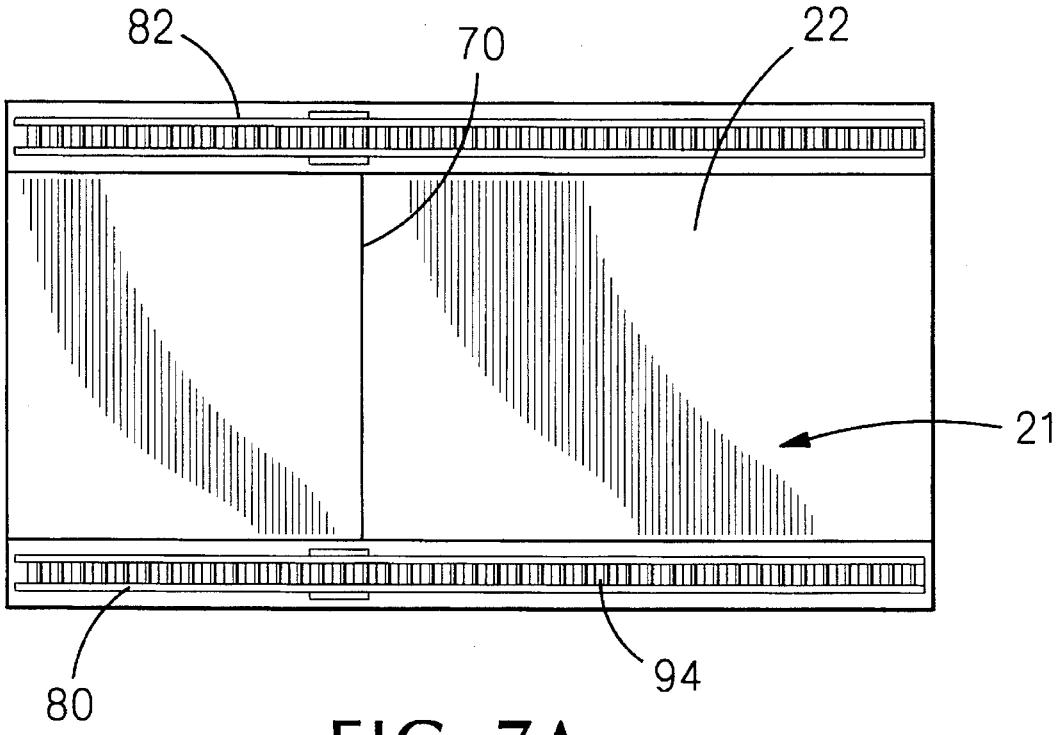
FIGS. 7(A) and 7(B) are fragmentary, partially schematic, top plan and side elevational views, respectively, of the device of FIGS. 6(A) and 6(B).
Figure 7B:
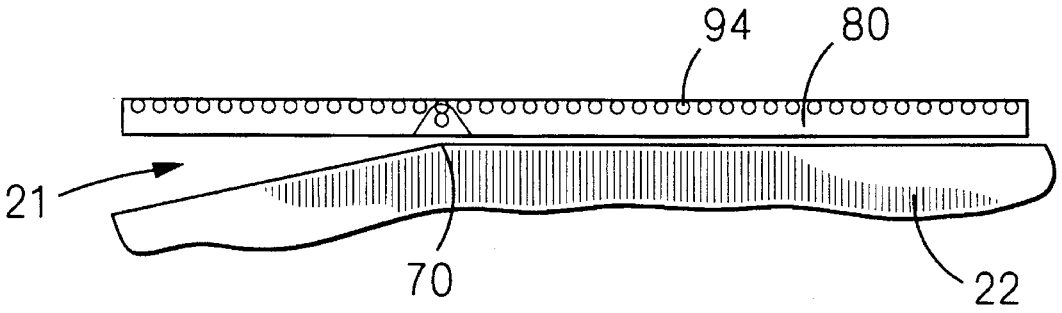

Referring to FIGS. 7(A) and 7(B), it can be seen that the upper surfaces of rails 80 and 82 comprise a plurality of freely rotating rollers, as at 94, having their axes aligned orthogonal to the axis of movement of riding pusher boat to greatly reduce frictional contact with the bottom of the hull of the riding pusher boat so that it can be launched as quickly as possible.

To increase the speed of launching riding pusher boat 30, the bottom surface of recess 21 may be covered with sheets of a high molecular weight plastic material 98 (FIG. 6(B)) to reduce further reduce sliding friction.

It will thus be seen that the objects set forth above, among those elucidated in, or made apparent from, the preceding description, are efficiently attained and, since certain changes may be made in the above construction without departing from the scope of the invention, it is intended that all matter contained in the above description or shown on the accompanying drawing figures shall be interpreted as illustrative only and not in a limiting sense.

It is also to be understood that the following claims are intended to cover all of the generic and specific features of the invention herein described and all statements of the scope of the invention which, as a matter of language, might be said to fall therebetween.

I claim:

1. An integrated tug/barge for carrying cargo, comprising:

(a) a cargo carrying barge, said barge having no means of propulsion; and (b) a tug boat mounted on top of a portion of said barge such that said tug boat and said barge will experience identical motion when said integrated tug/barge is operated, said tug boat including means for propulsion and maneuvering of said integrated tug/barge, with a portion of said means for propulsion and maneuvering being disposed below the surface of the water in which said integrated tug/barge is floating, the hull portion of said tug boat when so mounted being vertically disposed substantially no lower than said surface of said water, except for said portion of said means for propulsion and maneuvering.

2. An integrated tug/barge, as defined in claim 1, wherein: said tug boat is mounted in an aftwardly open recess formed in the stern section of said barge.

3. An integrated tug/barge, as defined in claim 2, further comprising: means to permit rapid separation and launching of said tug boat from said barge in the event of an emergency.

4. An integrated tug/barge, as defined in claim 3, wherein: said means to permit includes an aftwardly and downwardly sloped surface defining at least a portion of the bottom of said recess in which said tug boat is mounted.

5. An integrated tug/barge, as defined in claim 3, wherein: said means to permit includes a rotating structure disposed in said recess in which said tug boat is mounted and on which said rotating structure said tug boat is at least partially mounted, to rotate said tug boat toward the stern of said barge when said tug boat is being launched from said barge.

6. An integrated tug/barge, as defined in claim 5, wherein: upper surfaces of said rotating structure have rollers disposed thereon to reduce rolling friction as said tug boat is launched from said barge.

7. An integrated tug/barge, as defined in claim 4, wherein:

(a) a first, forward portion of the hull bottom of said tug boat is flat and horizontal;

(b) a second portion of said hull bottom is flat and inclined aftwardly and downwardly from said first portion; and (c) said sloped portion of said bottom of said recess and a horizontal portion of said bottom of said recess are joined at a knuckle point and engage, respectively, said first and second portions of said hull bottom of said tug boat.

8. An integrated tug/barge, as defined in claim 7, wherein:

(a) said first portion of said hull bottom comprises about 40–45% of the length of said hull bottom and said second portion of said hull bottom comprises about 25–30% of said length of said hull bottom; and (b) said tug boat has its center of gravity forward of said knuckle point when said tug boat is mounted on said barge.

9. An integrated tug/barge, as defined in claim 7, wherein: said second portion of said hull bottom is inclined from horizontal by about 11 degrees.

10. An integrated tug/barge, as defined in claim 1, wherein:

(a) a first, forward portion of the hull bottom of said tug boat is flat and horizontal;

(b) a second portion of said hull bottom is flat and inclined aftwardly and downwardly from said first portion; and (c) a third portion of said hull bottom is flat and extends aftwardly from said second portion.

11. An integrated tug/barge, as defined in claim 10, wherein:

(a) said first portion comprises about 40–45% of the length of said hull bottom;

(b) said second portion comprises about 25–30% of said length of said hull bottom; and (c) said third portion comprises about 20% of said length of said hull bottom.

12. An integrated tug/barge, as defined in claim 10, wherein: said second portion of said hull bottom is inclined from horizontal by about 11 degrees.

13. An integrated tug/barge, as defined in claim 10, wherein: propulsion means depends from said third portion.

14. An integrated tug/barge, as defined in claim 1, wherein: said tug boat has a wedge-shaped stern formed by two generally vertical plates joined at a generally vertical apex on the centerline of said tug boat.

15. A method of launching a tug boat from an integrated tug/barge, said tug/barge including: a cargo carrying barge, said barge having no means of propulsion; a tug boat mounted in a recess formed in a portion of said barge such that said tug boat and said barge will experience identical motion when said integrated tug/barge is operated, said tug boat including means for propulsion and maneuvering of said integrated tug/barge; a first, forward portion of the hull bottom of said tug boat is flat and horizontal, a second portion of said hull bottom is flat and inclined aftwardly and downwardly from said first portion, and a sloped portion of said bottom of said recess and a horizontal portion of said bottom of said recess are joined at a knuckle point and engage, respectively, said first and second portions of said hull bottom of said tug boat; and said tug boat having its center of gravity forward of said knuckle point when said tug boat is mounted on said barge; said method comprising:

(a) pushing said tug boat aftward until said center of gravity is aft of said knuckle point; and (b) permitting said tug boat to slide down said sloped portion of said bottom of said recess into water in which said barge is floating.

16. A method, as defined in claim 15, further comprising:

(a) providing a rotating structure disposed in said recess and on which said rotating structure said tug boat is at least partially mounted, to rotate said tug boat toward the stern of said barge when said tug boat is being launched from said barge; and (b) rotating said rotatable structure to rotate said tug boat toward the stern of said barge when said center of gravity is aft of said knuckle point.

17. A method, as defined in claim 16, further comprising: providing upper surfaces of said rotating structure with rollers disposed thereon to reduce rolling friction as said tug boat is launched from said barge.

18. A method of forming an integrated tug/barge, said tug/barge including: a cargo carrying barge, said barge having no means of propulsion; a tug boat mounted in a recess formed in a portion of said barge such that said tug boat and said barge will experience identical motion when said integrated tug/barge is operated, said tug boat including means for propulsion and maneuvering of said integrated tug/barge; said method comprising:

(a) ballasting said barge so that the bottom of said recess is under the surface of water in which said tug boat and said barge are floating;

(b) using said means for propulsion to propel said tug boat into said recess;

(c) securing said tug boat to said barge; and (d) reballasting said barge to a normal position in said water, with the hull portion of said tug boat being vertically disposed substantially no lower than the surface of the water in which said integrated tug/barge is floating, except for a portion of said means for propulsion and maneuvering being disposed below said surface of said water.

19. An integrated tug/barge for carrying cargo, comprising:

(a) a cargo carrying barge, said barge having no means of propulsion;

(b) a tug boat mounted on top of an aftwardly open recess formed in the stern section of said barge, portion of said barge such that said tug boat and said barge will experience identical motion when said integrated tug/barge is operated, said tug boat including means for propulsion and maneuvering of said integrated tug/barge; and (c) means to permit rapid separation and launching of said tug boat from said barge in the event of an emergency, said means including a rotating structure disposed in said recess in which said tug boat is mounted and on which said rotating structure said tug boat is at least partially mounted, to rotate said tug boat toward the stern of said barge when said tug boat is being launched from said barge.

20. An integrated tug/barge, as defined in claim 19, wherein: upper surfaces of said rotating structure have rollers disposed thereon to reduce rolling friction as said tug boat is launched from said barge.

21. An integrated tug/barge for carrying cargo, comprising:

(a) a cargo carrying barge, said barge having no means of propulsion;

(b) a tug boat mounted on top of a portion of said barge such that said tug boat and said barge will experience identical motion when said integrated tug/barge is operated, said tug boat including means for propulsion and maneuvering of said integrated tug/barge;

(c) a first, forward portion of the hull bottom of said tug boat is flat and horizontal;

(d) a second portion of said hull bottom is flat and inclined aftwardly and downwardly from said first portion; and (e) a third portion of said hull bottom is flat and extends aftwardly from said second portion.

22. An integrated tug/barge, as defined in claim 21, wherein:

(a) said first portion comprises about 40–45% of the length of said hull bottom;

(b) said second portion comprises about 25–30% of said length of said hull bottom; and (c) said third portion comprises about 20% of said length of said hull bottom.

23. An integrated tug/barge, as defined in claim 21, wherein: said second portion of said hull bottom is inclined from horizontal by about 11 degrees.

24. An integrated tug/barge, as defined in claim 21, wherein: propulsion means depends from said third portion.

* * * * *

UNITED STATES PATENT AND TRADEMARK OFFICE

CERTIFICATE OF CORRECTION

PATENT NO. : 5,558,036

DATED : September 24, 1995

INVENTOR(S) : James H. Hara

It is certified that error appears in the above-indentified patent and that said Letters Patent is hereby corrected as shown below:

Item [73],

In the title page, the address of the assignee is correctd to read ---Greenwich, Connecticut---.

Signed and Sealed this

Seventeenth Day of December, 1996

*Attest:*

Bruce Lehman

BRUCE LEHMAN

*Attesting Officer*

*Commissioner of Patents and Trademarks*